United States Patent [19]

Parker et al.

[11] Patent Number: 4,764,084

[45] Date of Patent: Aug. 16, 1988

[54] INLET FLOW GUIDE FOR A LOW PRESSURE TURBINE

[75] Inventors: David M. Parker, Oviedo; John C. Groenendaal, Jr., Winter Springs, both of Fla.

[73] Assignee: Westinghouse Electric Corp., Pittsburgh, Pa.

[21] Appl. No.: 124,301

[22] Filed: Nov. 23, 1987

[51] Int. Cl.[4] ..... F01D 3/02

[52] U.S. Cl. ..... 415/101; 415/99; 415/102; 415/139; 416/199; 403/28; 285/187

[58] Field of Search ..... 415/101, 102, 93, 97, 415/99, 134, 136, 138, 139, 103; 416/199; 403/28; 285/187, 369

[56] References Cited

U.S. PATENT DOCUMENTS

| | | | |
|---|---|---|---|
| 1,089,710 | 3/1914 | Junggren | 415/103 |
| 2,102,416 | 12/1937 | Junggren | 415/103 |
| 2,472,062 | 6/1949 | Boestad et al. | 415/139 |
| 2,809,057 | 10/1957 | McEachern | 285/187 |
| 3,408,045 | 10/1968 | Hart | 415/138 |
| 3,804,565 | 4/1974 | Sennet et al. | 415/99 |
| 4,363,505 | 12/1982 | Smith | 285/369 |
| 4,447,966 | 5/1984 | Mollenkopf et al. | 403/28 |
| 4,571,153 | 2/1986 | Keller | 415/103 |

*Primary Examiner*—Robert E. Garrett
*Assistant Examiner*—John T. Kwon

[57] ABSTRACT

The inlet flow guide includes a generally cylindrical shroud plate, a generally cylindrical bridge piece, elongated attachment members, biasing members and sealing members. The shroud plate is in confronting cylindrical sections, is adapted to be attached to the pair of confronting stationary blades of the annular rows of turbine blades, and includes tapped bores therethrough. The cylindrical sections of the shroud plate are in arc cylindrical sections. The bridge piece is in semi cylindrical sections and has bores therethrough of a predetermined size to accommodate expected movements during the operation of the turbine, and which are capable of alignment with the bores of the shroud plate. The attachment members have enlarged heads and shoulders and are disposed within the bores of the bridge piece and shroud plate to attach the bridge piece to the shroud plate. The biasing members are disposed between the heads of the attachment members and the bridge piece to apply a predetermined load to the bridge piece as the attachment members are tightened. The sealing members are disposed between each of the biasing member and the bridge piece to block the flow of low pressure steam through the bores in the bridge piece and to provide a seat for the biasing members.

21 Claims, 3 Drawing Sheets

INLET FLOW GUIDE FOR A LOW PRESSURE TURBINE

BACKGROUND OF THE INVENTION

The present invention relates to an inlet flow guide for a low pressure turbine.

Low pressure turbines include an inlet flow guide disposed along the path of flow of steam through the turbine to direct the incoming steam into two flow paths. The streams flow past separate arrays of turbine blades, which generally begin with stationary blades, before being exhausted from the turbine.

The inlet flow guide is generally a shroud plate attached to, and extending between, the first opposed stationary blades. Heretofore, the inlet flow guides have been supported within the turbine by radial supports attached to the turbine housing. These radial supports interfere with the steam flow, which in turn, can cause the inlet flow guide and the blades to vibrate, creating excessive stress and wear on those portions of the turbine. Further, steam leaks through the gap between circumferential sections of the shroud plate. Thus, clamping members are used to prevent the vibration of the inlet flow guide and turbine blades, and spring back-type seals are used to inhibit steam leakage.

It is desired to develop an inlet flow guide that has a simplified overall structure by requiring a reduced number of associated supports, clamping members and seals, and places a reduced amount of stress on its component parts.

SUMMARY OF THE INVENTION

The inlet flow guide of the invention is for use in a low pressure turbine that includes a generally cylindrical housing, and an opposed pair of annular arrays of blades having a pair of confronting stationary blades disposed within the housing.

The inlet flow guide includes a generally cylindrical shroud plate, a generally cylindrical bridge piece, a plurality of elongated attachment members, a plurality of biasing means and a plurality of sealing means. The shroud plate is in confronting cylindrical sections, is adapted to be attached to the pair of confronting stationary blades of the opposed pair of annular rows of blades of the turbine, and includes a plurality of tapped bores therethrough. The bridge piece is in cylindrical sections and has a plurality of bores therethrough which are capable of alignment with the bores of the shroud plate. The bores are of a predetermined size to accommodate expected thermal, mechanical and pressure movement or displacement during the operation of the turbine. The attachment members have enlarged heads and shoulders and are disposed within the bores of the bridge piece and shroud plate to secure the bridge piece to the shroud plate. The biasing means are disposed between the enlarged heads of the attachment members and the bridge piece to apply a predetermined load to the bridge piece as the attachment members are tightened. The sealing means are disposed between each of the biasing means and the bridge piece to block the flow of low pressure steam through the bores in the bridge piece and to provide a seat for the biasing means.

The inlet flow guide of the invention is specially suitable for high steam temperature inlets. The design of the inlet flow guide reduces the stress on the component parts thereof and the turbine blades because it allows for thermal expansion and contraction of the component parts of the inlet flow guide and prevents excessive vibration thereof.

BRIEF DESCRIPTION OF THE DRAWINGS

These and other objects, features and advantages of the invention will become more fully apparent from the following detailed description and accompanying drawings in which.

DETAILED DESCRIPTION OF THE PREFERRED EMBODIMENTS

Figure 1:
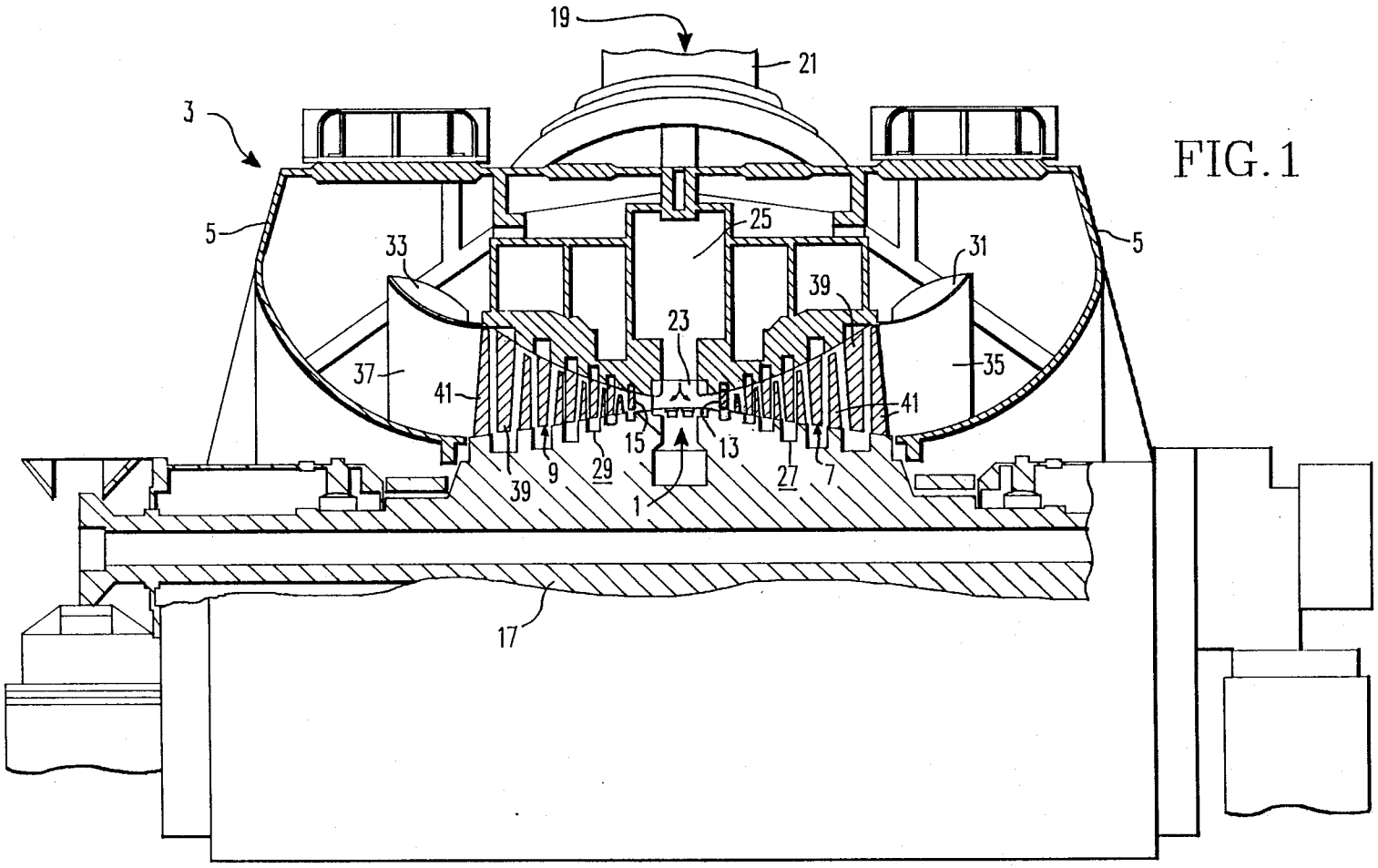
FIG. 1 is a cross-sectional view of a turbine in which the inlet flow guide of the invention is employed.

The inlet flow guide 1 of the invention is for use in a low pressure turbine 3. The low pressure turbine 3 includes a generally cylindrical housing 5 and an opposed pair of annular arrays of blades 7 and 9 disposed within the housing 5. Typically, the opposed pair of annular arrays of blades 7 and 9 are formed of rows of blades 41. The opposed pair of annular arrays of blades 7 and 9 have a pair of confronting stationary blades 13 and 15, respectively. Typically, the opposed pair of annular arrays of blades 7 and 9 are radially disposed about a rotor 17 that is rotatably mounted within the housing 5 of the low pressure turbine 3.

The housing 5 of the low pressure turbine 3 has a steam passageway 19 therethrough having an inlet 21 adapted to be in flow communication with a source of low pressure steam. A stream of low pressure steam flowing through the steam passageway 19 enters the housing 5 through the inlet 21, flows through a flow passage 23 by the inlet flow guide 1 and is divided into two streams. Preferably, the inlet flow guide 1 is disposed near the inlet 21 to the housing 5 of the low pressure turbine 3. More preferably, the steam flows through the inlet 21 to an inlet chamber 25 and then flows past the inlet flow guide 1 and through one of blade passages 27 and 29, respectively.

One of the streams flows through the blade passage 27 past the annular array of blades 7 to an exhaust flow guide 31 and is exhausted from the housing 5. The other of the streams flows through the blade passage 29 past the annular array of blades 9 to an exhaust flow guide 33 and is exhausted from the housing 5. Typically, the streams pass through diffusers 35 and 37, respectively, before being exhausted from the housing 5 through the exhaust flow guides 31 and 33, respectively. The exhausted steam is generally directed to a condenser (not shown) and eventually recirculated to the turbine 3.

The flow of the low pressure steam through the steam passageway 19 past the opposed pair of annular arrays of blades 7 and 9 causes the rotor 17 to rotate axially to drive an electrical power generator (not shown).

The opposed pair of annular arrays of blades 7 and 9 extend axially in opposite directions along the rotor 17 from the inlet flow guide 1, and begin with the annular confronting stationary blades 13 and 15, respectively. Preferably, the opposed pair of annular arrays of blades 7 and 9 have alternating stationary blades 39 and rotating blades 41.

The inlet flow guide 1 (FIG. 2) includes a generally cylindrical shroud plate 43, a generally cylindrical bridge piece 45, a plurality of elongated attachment members 47, a plurality of biasing means 49 and a plurality of sealing means 51.

Figure 3:
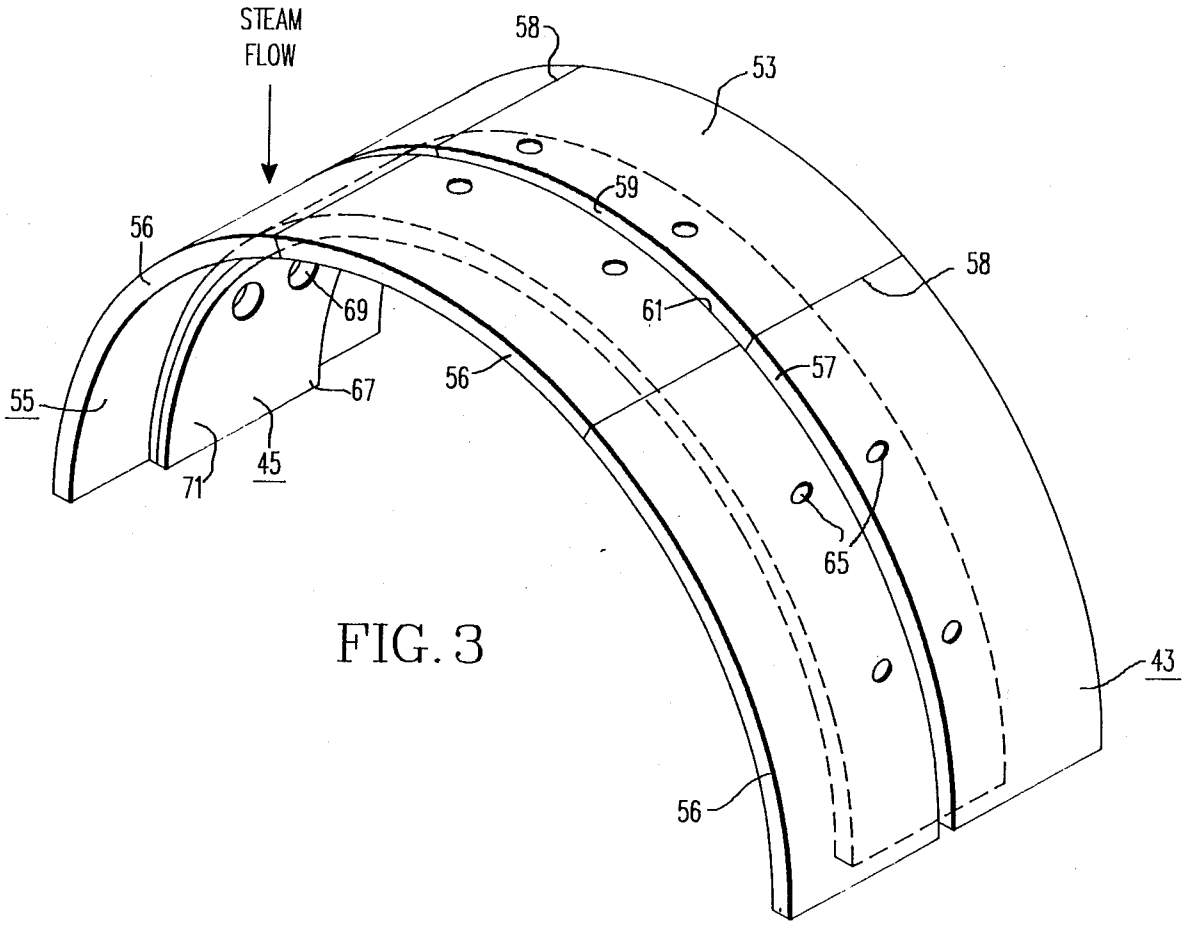
FIG. 3 is a perspective view, partly in section, of one half of the shroud plate and bridge piece.

The shroud plate 43 is in a plurality of confronting cylindrical sections, preferably two confronting cylindrical sections 53 and 55. The sections 53 and 55 of the shroud plate 43 are, in turn, in a plurality of, preferably from six to eight, arc sections 56, which can be welded together after assembly shown by the welds 58 (FIG. 3). A gap 57 is left between the confronting ends 59 and 61, respectively, of the sections 53 and 55 to allow for thermal expansion and contraction of the shroud plate 43 and associated portions of the housing 5. The shroud plate 43 is adapted to be secured to the pair of confronting stationary blades 13 and 15 of the opposed pair of annular arrays of blades 7 and 9 of the low pressure turbine 3 by conventional means, such as rivets 63. The shroud plate 43 further includes a plurality of tapped bores 65 therethrough, that are adapted to receive the attachment members 47 to secure the bridge piece 45 to the shroud plate 43.

Figure 2:
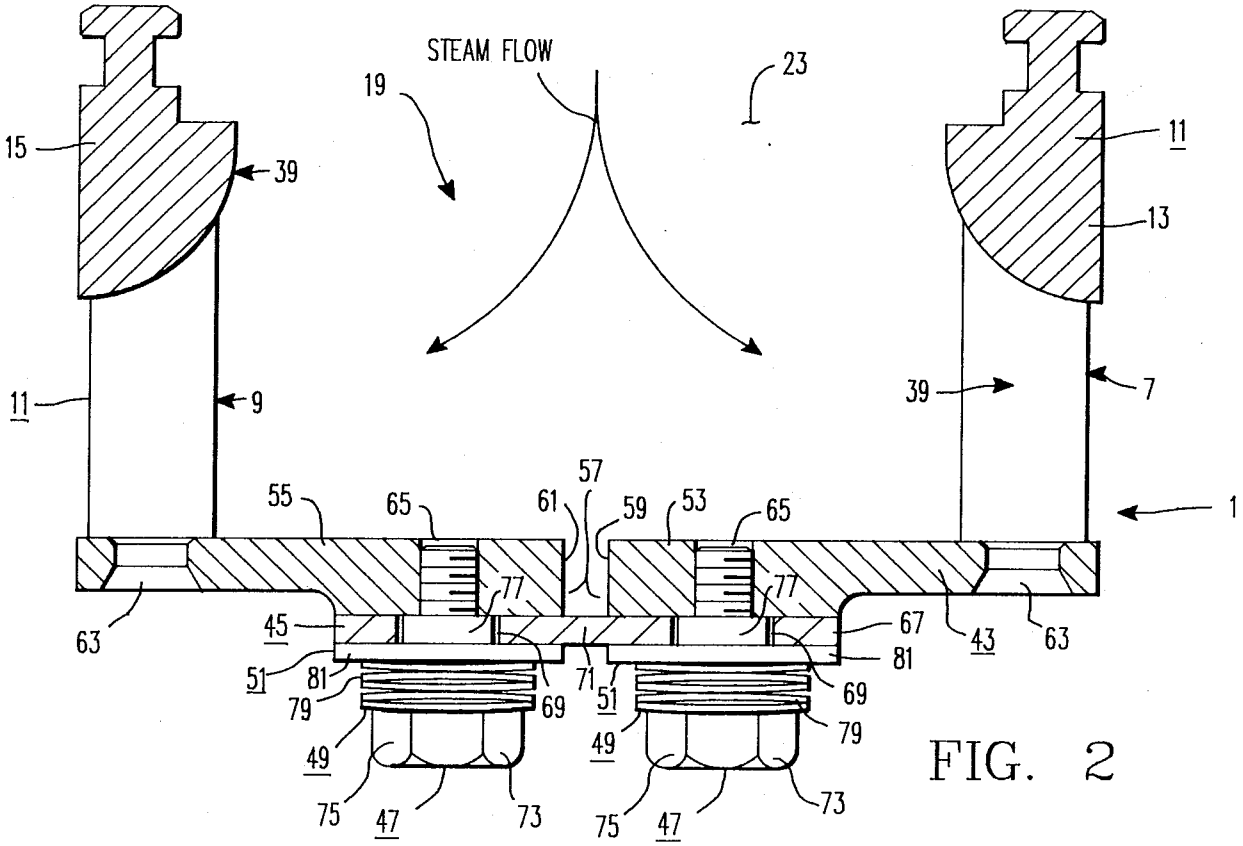
FIG. 2 is a cross-sectional view of the inlet flow guide of the invention.

The bridge piece 45 is in a plurality of arc cylindrical sections 67. The bridge piece 45 has a plurality of bores 69 therethrough which are capable of alignment with the bores 65 of the shroud plate 43. The bores 69 receive the attachment members 47 to secure the bridge piece 45 to the sections 53 and 55 of the shroud plate 43. The bores 69 are of a predetermined size to accommodate expected thermal, mechanical and pressure movement or displacement during the operation of the low pressure turbine 3. Preferably, the bridge piece 45 is in two semi-cylindrical sections. One of the semi-cylindrical sections, semi-cylindrical section 71, is illustrated in FIG. 2, the other, a mirror image of the semi-cylindrical section 71 is not shown. Steam leakage between the cylindrical sections 53 and 55 of the shroud plate 43 is low since the gap 57 between the sections 53 and 55 of the shroud plate 43 is plugged by the bridge piece 45.

The attachment members 47 are disposed within the bores 69 of the bridge piece 45 and the bores 65 of the shroud plate 43 to secure the bridge piece 45 to the shroud plate 43. Preferably, the attachment members 47 are threaded shoulder bolts 73, having enlarged heads 75 and shoulders 77, which threadedly engage in the tapped bores 65 in the shroud plate 43. The attachment members 47 provide controlled or calibrated clamping forces between the shoulders 77 of the attachment members 47 and the shroud plate 43.

The biasing means 49 are disposed between the attachment members 47 and the bridge piece 45 to apply a predetermined load to the bridge piece 45 as the attachment members 47 are tightened. The use of the biasing means 49 provides controlled clamping and controlled movement of the bridge piece 45 and shroud plate 43 with respect to each other to allow for thermal expansion of those pieces, as well as the associated portions of the housing 5, without load buildup. Preferably, the biasing means 49 are spring washers 79.

The sealing means 51 are disposed between each of the biasing means 49 and the bridge piece 45 to block the flow of low pressure steam through the bores 69 in the bridge piece 45 and to provide a seat for the biasing means 49. Preferably, the sealing means 51 are flat fitted washers 81.

In order to secure the inlet flow guide 1 of the invention within a low pressure turbine 3, the bridge piece 45 is positioned so that the bores 69 of the bridge piece 45 are aligned with the bores 65 of the shroud plate 43. The biasing means 49 and the sealing means 51 are inserted over the attachment members 47 and the attachment members 47 are disposed and tightened within the bores 69 of the bridge piece 45 and the bores 65 of the shroud plate 43. The inlet flow guide 1 is then positioned within the low pressure turbine 3 and the shroud plate 43 is secured to the confronting stationary blades 13 and 15.

The inlet flow guide 1 of the invention requires a reduced number of associated supports, clamping members and seals. The inlet flow guide 1 places a reduced amount of stress on its component parts and the turbine blades 41 because it allows for thermal expansion and contraction of the parts of the inlet flow guide 1 and associated portions of the housing 5 and prevents excessive vibration of the turbine blades 41.

What is claimed is:

1. An inlet flow guide for a low pressure turbine that includes a generally cylindrical housing, and an opposed pair of annular arrays of blades having a pair of confronting stationary blades disposed within the housing; said inlet flow guide comprising:

a generally cylindrical shroud plate, said shroud plate being in a plurality of confronting cylindrical sections, each of said confronting cylindrical sections being in a plurality of arc cylindrical sections, said shroud plate being adapted to be attached to said pair of confronting stationary blades of a said low pressure turbine, and having a plurality of tapped bores therethrough;

a generally cylindrical bridge piece, said bridge piece being in a plurality of semi cylindrical sections and having a plurality of bores therethrough, which are capable of alignment with said bores of said shroud plate, said bores being of a predetermined size to accommodate expected thermal, mechanical and pressure movement or displacement during the operation of said turbine;

a plurality of elongated attachment members disposed within said bores of said bridge piece and shroud plate to secure said bridge piece to said shroud plate, said elongated attachment members having enlarged heads and shoulders;

a plurality of biasing means disposed between said enlarged heads of said elongated attachment members and said bridge piece for applying a predetermined load to said bridge piece as said elongated attachment members are tightened; and a plurality of sealing means disposed between each of said biasing means and said bridge piece to block the flow of low pressure steam through said bores in said bridge piece and to provide a seat for biasing means.

2. The inlet flow guide of claim 1 wherein said shroud plate is in two cylindrical sections.

3. The inlet flow guide of claim 2 wherein said cylindrical sections of said shroud plate are both formed of from six to eight arc cylindrical sections.

4. The inlet flow guide of claim 1 wherein said bridge piece is formed of two semi-cylindrical sections.

5. The inlet flow guide of claim 1 wherein said elongated attachment members are threaded, and threadedly engage with threads in said tapped bores of said shroud plate.

6. The inlet flow guide of claim 5 wherein said elongated attachment members are bolts.

7. The inlet flow guide of claim 1 wherein said biasing means are spring washers.

8. The inlet flow guide of claim 1 wherein said sealing means are flat fitted washers.

9. An inlet flow guide for a low pressure turbine that includes a generally cylindrical housing, and an opposed pair of annular arrays of blades having a pair of confronting stationary blades disposed within the housing; said inlet flow guide comprising:

a generally cylindrical shroud plate, said shroud plate being in two confronting cylindrical sections, each of said confronting cylindrical sections being in from six to eight arc cylindrical sections, said shroud plate being adapted to be attached to said pair of confronting stationary blades of a said low pressure turbine, and having a plurality of tapped bores therethrough;

a generally cylindrical bridge piece, said bridge piece being in two semi-cylindrical sections and having a plurality of bores therethrough, which are capable of alignment with said bores of said shroud plate, said bores being of a predetermined size to accommodate expected thermal, mechanical and pressure movement or displacement during the operation of said turbine;

a plurality of threaded bolts, having enlarged heads and shoulders, disposed within said bores of said bridge piece and shroud plate to secure said bridge piece to said shroud plate;

a plurality of spring washers disposed between said enlarged heads of said threaded bolts and said bridge piece for applying a predetermined load to said bridge piece as said threaded bolts are tightened; and a plurality of flat fitted washers disposed between each of said spring washers and said bridge piece to block the flow of low pressure steam through said bores in said bridge piece and to provide a seat for spring washers.

10. A low pressure turbine comprising:

a generally cylindrical housing;

a rotor rotatably mounted within said housing;

an opposed pair of annular arrays of blades on said rotor extending axially therefrom; and a steam passageway through said housing having an inlet adapted to be in flow communication with a source of low pressure steam, and an inlet flow guide to divide a stream of low pressure steam into two streams, one of said streams flowing past one of said opposed pair of annular arrays of blades, the other of said streams flowing past the other of said opposed pair of annular arrays of blades;

said opposed pair of annular arrays of blades beginning with a pair of confronting stationary blades;

said inlet flow guide comprising;

a. a generally cylindrical shroud plate, said shroud plate being in a plurality of confronting cylindrical sections, each of said confronting cylindrical sections being in a plurality of arc cylindrical sections, said shroud plate being adapted to be attached to said pair of confronting stationary blades, and having a plurality of tapped bores therethrough;

b. a generally cylindrical bridge piece, said bridge piece being in a plurality of semi cylindrical sections and having a plurality of bores therethrough, which are capable of alignment with said bores of said shroud plate, said bores being of a predetermined size to accommodate expected thermal, mechanical and pressure movement or displacement during the operation of the turbine;

c. a plurality of elongated attachment members disposed within said bores of said bridge piece and shroud plate to secure said bridge piece to said shroud plate, said elongated attachment members having enlarged heads and shoulders;

d. a plurality of biasing means disposed between said enlarged heads of said elongated attachment members and said bridge piece for applying a predetermined load to said bridge piece as said elongated attachment members are tightened; and e. a plurality of sealing means disposed between each of said biasing means and said bridge piece to block the flow of low pressure steam through said bores in said bridge piece and to provide a seat for said biasing means.

11. The low pressure turbine of claim 10 wherein said inlet flow guide is disposed along said steam passageway.

12. The low pressure turbine of claim 11 wherein said steam passageway has a steam inlet chamber at said inlet end that leads to said inlet flow guide.

13. The low pressure turbine of claim 10 in which the blades of said opposed pair of annular arrays of blades are alternately stationary blades and rotating blades.

14. The low pressure turbine of claim 10 wherein said steam passageway has an exhaust flow guide and a diffuser disposed at said exhaust flow guide.

15. The low pressure turbine of claim 10 wherein said shroud plate is in two cylindrical sections.

16. The low pressure turbine of claim 10 wherein said cylindrical sections of said shroud plate are both formed of from six to eight arc cylindrical sections.

17. The low pressure turbine of claim 10 wherein said bridge piece is formed of two semi-cylindrical sections.

18. The low pressure turbine of claim 10 wherein said elongated attachment members are threaded, and threadedly engage with threads in said tapped bores of said shroud plate.

19. The low pressure turbine of claim 18 wherein said elongated attachment members are bolts.

20. The low pressure turbine of claim 19 wherein said biasing means are spring washers.

21. The low pressure turbine of claim 20 wherein said sealing means are flat fitted washers.

* * * * *